United States Patent [19]

Petrovsky et al.

[11] Patent Number: 4,498,848

[45] Date of Patent: Feb. 12, 1985

[54] RECIPROCATING PISTON AIR COMPRESSOR

[75] Inventors: Ján Petrovsky, Schorndorf; Heinz Roloff, Stuttgart, both of Fed. Rep. of Germany

[73] Assignee: Daimler-Benz Aktiengesellschaft, Stuttgart, Fed. Rep. of Germany

[21] Appl. No.: 479,148

[22] Filed: Mar. 28, 1983

[30] Foreign Application Priority Data

Mar. 30, 1982 [DE] Fed. Rep. of Germany ..... 3211598

[51] Int. Cl.[3] ..... F04B 25/00; F04B 39/08; F04B 39/10; F04B 49/02

[52] U.S. Cl. ..... 417/253; 417/295; 417/307; 417/493; 417/505

[58] Field of Search ..... 417/289, 364, 295, 490, 417/493, 435, 253, 306, 307, 298, 503, 505

[56] References Cited

U.S. PATENT DOCUMENTS

| | | | |
|---|---|---|---|
| 457,762 | 8/1891 | Dittmar et al. | 417/505 |
| 740,771 | 10/1903 | McIntyre | 417/242 |
| 2,772,828 | 10/1952 | Bush | 417/250 X |
| 2,812,893 | 11/1957 | Cotter | 417/307 X |
| 3,259,077 | 7/1966 | Wiley et al. | 415/505 |
| 3,915,597 | 10/1975 | Grant et al. | 417/490 |

FOREIGN PATENT DOCUMENTS

| | | | |
|---|---|---|---|
| 466254 | 6/1950 | Canada | 417/490 |
| 2023233 | 12/1979 | United Kingdom | 417/364 |

*Primary Examiner*—Richard E. Gluck
*Assistant Examiner*—T. Olds
*Attorney, Agent, or Firm*—Barnes & Thornburg

[57] ABSTRACT

In a reciprocating piston air compressor, air is induced via an intake valve in the compressor cylinder head and, in addition, air which has been pre-compressed on the rear side of the piston is forced into the cylinder space via slots in the cylinder wall controlled by the piston. The delivery and the efficiency of the air compressor are improved according to the invention by the provision that the pre-compression of the air occurs by means of a turbo-compressor and that during the return stroke of the piston, the cylinder space is connected with an additional clearance space via an opened control valve in the cylinder head, by means of which the hot compressed air which has not been expelled is replaced by cooler air.

5 Claims, 1 Drawing Figure

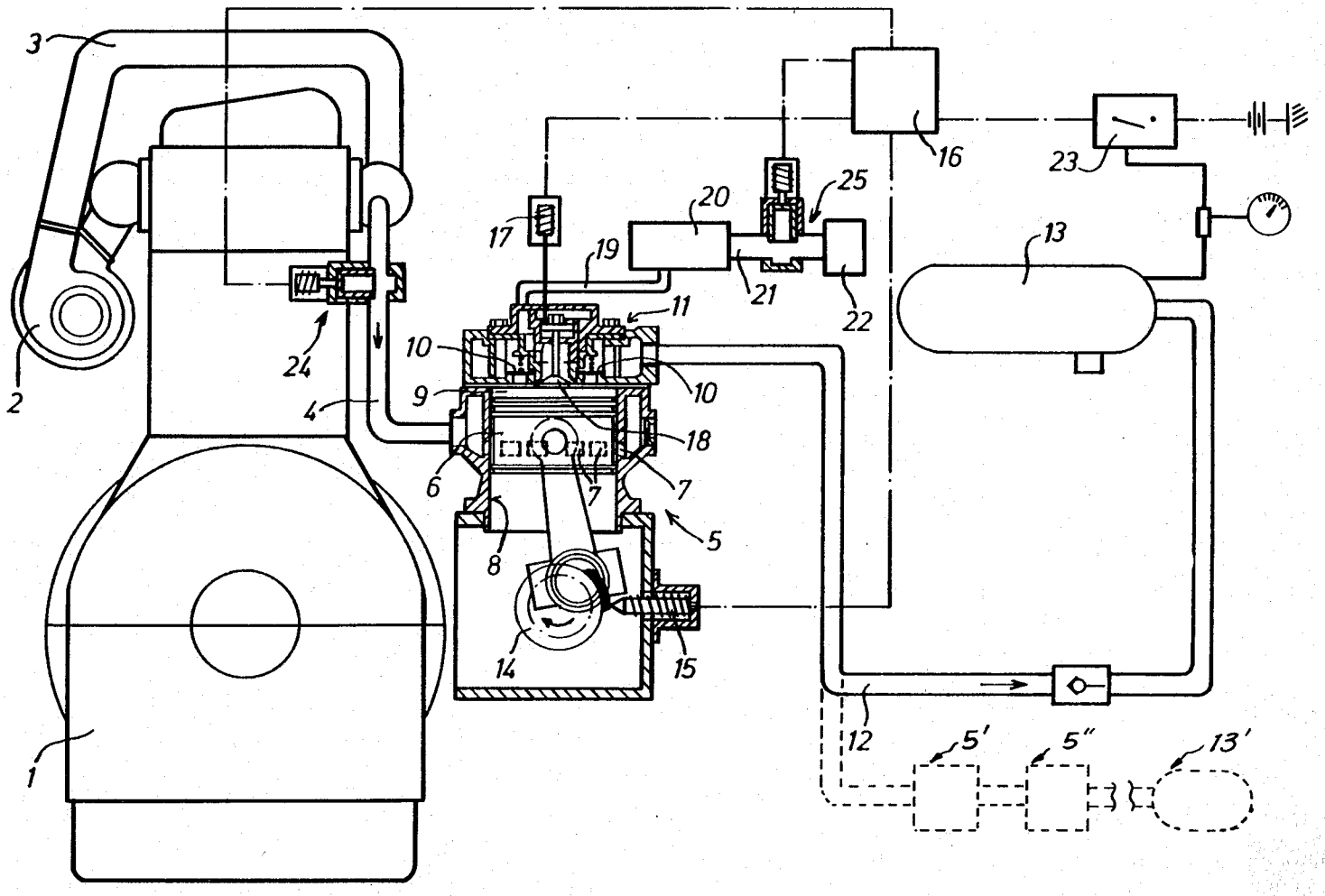
1
2
3
4
5
5'
5''
6
7
8
9
10
11
12
13
13'
14
15
16
17
18
19
20
21
22
23
24
25

RECIPROCATING PISTON AIR COMPRESSOR

BACKGROUND AND SUMMARY OF THE INVENTION

The present invention is related to reciprocating piston air compressors of the type having a cylinder wall with slots for controlling the inlet of pre-compressed air to be compressed and with at least one outlet valve in the cylinder head for the removal of the compressed air.

An air compressor of this general type is known from German Patent Specification 304,021. In this air compressor, the pre-compression occurs in a chamber at the rear side of the piston, only a small degree of compression being obtained. The valve located in the cylinder head and connecting the cylinder space with the external air (air inlet) is a spring-loaded snuffler valve which does not open during the piston return stroke until the pressure in the cylinder space becomes less than the external pressure.

The invention is based on the objective of increasing the delivery of the air compressor and the final pressure of the compressed air, particularly in conjunction with an improved volumetric efficiency.

The present invention solves these problems by providing a second valve connecting the cylinder space with the external air and by controlling the second valve as a function of the compressor crankshaft angle in such a way that it opens during the piston return stroke between the closing of the outlet valve and the opening of the slots and connects the cylinder space with an additional dead or storage space which is in turn connected with the external air.

Using a turbo-charger, a substantially higher pre-compression pressure is obtainable than in the case of the known air compressor. The possibly higher thermal loading resulting from this arrangement, the main effect of which is to have an unfavorable influence on the efficiency of the air compressor, is reduced in the subject of the invention by the fact that the compressed hot air remaining in the cylinder space after the closing of the outlet valve at the beginning of the piston return stroke flows into the additional dead space via the open regulating valve and that during the subsequent return strokes, cooler air is induced via the regulating valve until, after the opening of the slots, the pre-compressed air flows into the cylinder space. The replacement of the hot air by the cooler air and the cooling of the cylinder sleeve associated therewith increases the cylinder volumetric efficiency and hence the efficiency and delivery of the air compressor.

In an especially preferred embodiment, during idling operation of the compressor, the regulating valve is continuously open and respective shut-off valves close the passage between the turbo-compressor and the air compressor and the passage from the additional dead space to the external air.

In this arrangement the cylinder dead space and the additional dead space connected with it via the open regulating valve are so large that practically no compression of the air enclosed thereby occurs, and hence the power consumption of the air compressor during idling is advantageously very small.

Using an air compressor comprising several similarly constructed compressor cylinders, high pressures are obtainable by stepwise air compression without the intermediate connection of an expensive air cooler being necessary. The limitation of the temperature of the compressed air obtainable using the invention is so substantial that the compression of the air to a high level occurs with a good volumetric efficiency and the final temperature of the air remains below certain values prescribed for use in a motor vehicle. Intermediate air receivers can be used with multiple cylinder compressor embodiments as needed.

Further objects, features, and advantages of the present invention will become more obvious from the following description when taken in connection with the accompanying drawing which shows, for purposes of illustration only, one embodiment in accordance with the present invention.

BRIEF DESCRIPTION OF THE DRAWING

The single drawing FIGURE schematically depicts an internal combustion engine with a part-sectional schematic depiction of an air compressor constructed in accordance with a preferred embodiment of the invention.

DETAILED DESCRIPTION OF THE DRAWING

An engine exhaust gas driven turbo-compressor 2 is installed on an internal combustion engine 1. Turbo-compressor 2 supplies the internal combustion engine 1 with fresh air through a pipe 3 and supplies an air compressor 5 with pre-compressed air via a pipe 4 branching off from the pipe 3. This pre-compressed air flows through slots 7 in a compressor cylinder wall 8, controlled by a reciprocating piston 6 of the air compressor 5, into the cylinder space 9 and is compressed by the working stroke of the piston 6. After a certain pressure is attained, outlet valves 10 (constructed as non-return valves) in cylinder head 11 open and the compressed air is delivered via a pipe 12 into a receiver or pressure storage tank 13.

Approximately at the beginning of the return stroke of the piston 6, i.e. approximately at the piston position shown in the drawing, a pressure balance occurs between the cylinder space 9 and the pipe 12, so that the outlet valves 10 close. Simultaneously, an inductive sensor 15 is operated as a function of the rotational angle of the air compressor 5 by a control disc 14 attached to the crankshaft of the air compressor and the inductive sensor 15 emits a signal to a control regulator 16. The control regulator 16 operates a control magnet 17, which opens a regulating valve 18 located in the cylinder head 11. At a certain rotational angle, which corresponds approximately to the commencement of the opening of the slots 7 by the piston 6, the sensor 15 emits a further signal which causes the control regulator 16 to close the regulator valve 18.

While the regulator valve 18 is being opened, the cylinder space 9 is connected via a pipe 19 with an additional dead or storage tank space 20, which is in turn connected with the external air via a pipe 21 and a filter 22. The hot compressed air, which has not been expelled into the pipe 12 and remains in the cylinder space 9 at the end of the working stroke of the piston 6, flows into the additional dead space 20 when the regulating valve 18 is opened. During the further return stroke of the piston 6, cooler air is drawn in via the regulating valve 18 through the cylinder space 9. This involves the loss of some energy contained in this compressed hot air, however, the replacement of the hot air by cooler air and the associated cooling of the cylinder wall 8 provides better filling of the cylinder space 9, thus giving an increased delivery and an improved efficiency.

If the operating pressure has been attained in the receiver 13, the control regulator 16 receives a signal from a pressure switch 23. This operates two shut-off valves 24 and 25 in the pipes 4 and 21 and they become closed in consequence. Simultaneously, the regulating valve 18 is set continuously open. The air compressor 5 now operates at idle, the connection of the additional dead space 20 to the cylinder space 9 causing very low compression work and therefore very low power consumption by the air compressor 5.

In a manner not shown, the air compressor can have several cylinders in which the air is compressed in stages. With this arrangement it is possible to produce highly compressed air without using air coolers. In addition to a receiver for the highly compressed air, a further receiver can also be provided for storing the air at medium pressure produced by the first cylinder.

While we have shown and described one embodiment in accordance with the present invention, it is understood that the same is not limited thereto, but is susceptible to numerous changes and modifications as would be known to those skilled in the art of the present disclosure and we therefore do not wish to be limited to the details shown and described therein, but intend to cover all such changes and modifications as are encompassed by the scope of the appended claims.

We claim:

1. Reciprocating piston air compressor with slots in a cylinder wall and a piston driven by a crankshaft for controlling admission of pre-compressed air and with at least one outlet valve for the removal of the compressed air together with a second valve connecting a cylinder space with the external air, wherein the second valve is controlled as a function of an angle of the compressor crankshaft to form a regulating valve which opens during the piston return stroke between the closing of the outlet valve and the opening of the slots and which connects the cylinder space with an additional dead or storage space, which is in turn connected with the external air, and wherein the air is pre-compressed by a turbocharger, and wherein, when the air compressor is idling, the regulating valve is continuously open and respective shut-off valves close the passage between the turbo-compressor and the air compressor and the passage from the additional dead space to the external air.

2. Air compressor according to claim 1, comprising several similarly constructed compressor cylinders, serially connected to provide for compression of the air in stages.

3. Air compressor according to claim 2, wherein at least one outlet valve and the second valve are located in a cylinder head at one end of the cylinder space.

4. Air compressor according to claim 2, wherein an intermediate receiver is connected to an output of at least one of said several cylinders.

5. Air compressor according to claim 1, wherein at least one outlet valve and the second valve are located in a cylinder head at one end of the cylinder space.

* * * * *

UNITED STATES PATENT AND TRADEMARK OFFICE

CERTIFICATE OF CORRECTION

PATENT NO. : 4,498,848

DATED : February 12, 1985

INVENTOR(S) : Jan Petrovsky, et al.

It is certified that error appears in the above-identified patent and that said Letters Patent is hereby corrected as shown below:

Column 3, line 13, delete "In a manner not shown" and insert therefore --As shown schematically in dashed lines in the figure--.

Column 3, line 18, delete "further".

Signed and Sealed this

*Tenth* Day of *September 1985*

[SEAL]

*Attest:*

DONALD J. QUIGG

*Attesting Officer* *Acting Commissioner of Patents and Trademarks - Designate*